US005860567A

United States Patent [19]

Fuchs et al.

[11] Patent Number: 5,860,567

[45] Date of Patent: Jan. 19, 1999

[54] DISPENSER FOR MEDIA INCLUDING A VALVED OUTLET

[75] Inventors: Karl Heinz Fuchs; Esther Amann, both of Radolfzell, Germany

[73] Assignee: Ing. Erich Pfeiffer GmbH, Radolfzell, Germany

[21] Appl. No.: 869,628

[22] Filed: Jun. 5, 1997

[30] Foreign Application Priority Data

Jun. 8, 1996 [DE] Germany ..... 196 23 030.6

[51] Int. Cl.[6] ..... B65D 37/00

[52] U.S. Cl. ..... 222/105; 222/212

[58] Field of Search ..... 222/105, 212, 222/481.5

[56] References Cited

U.S. PATENT DOCUMENTS

| | | | |
|---|---|---|---|
| 3,794,247 | 2/1974 | Corsette | 239/327 |
| 4,087,023 | 5/1978 | Szczepanski | 222/209 |
| 4,102,476 | 7/1978 | Loeffler | 222/209 |
| 4,146,182 | 3/1979 | Nilson | 239/323 |
| 4,179,049 | 12/1979 | Umstead | 222/631 |
| 4,239,132 | 12/1980 | Mueller et al. | 222/212 |
| 4,811,871 | 3/1989 | Wass et al. | 222/212 |
| 4,830,284 | 5/1989 | Maerte | 239/333 |
| 5,255,826 | 10/1993 | Ranalletta et al. | 222/212 |
| 5,273,191 | 12/1993 | Meshberg | 222/105 |
| 5,348,189 | 9/1994 | Cater | 222/1 |
| 5,429,275 | 7/1995 | Katz | 222/108 |
| 5,454,494 | 10/1995 | Lechelle | 222/494 |
| 5,462,208 | 10/1995 | Stahley et al. | 222/207 |

FOREIGN PATENT DOCUMENTS

| | | |
|---|---|---|
| 0 682 987 A2 | 5/1995 | European Pat. Off. . |
| 2 524 348 | 10/1983 | France . |
| 899 474 | 12/1953 | Germany . |
| 1904137 | 11/1964 | Germany . |
| 3843317 C2 | 5/1991 | Germany . |
| G 90 17 062.8 | 6/1991 | Germany . |
| 2901433 C2 | 8/1994 | Germany . |
| 4403755 A1 | 11/1994 | Germany . |
| 29518284 U1 | 3/1996 | Germany . |

OTHER PUBLICATIONS

European search report dated Jul. 1, 1998 in Appln. No. 97109187.1–2307.

German Search Report dated 15, Jan. 1997 in german Appl. No. 196 23 030.6.

*Primary Examiner*—Philippe Derakshani
*Attorney, Agent, or Firm*—Quarles & Brady

[57] ABSTRACT

A dispenser (1) includes in a casing (2) with a volume-variable storage chamber (11) for the medium, a discharge closure (10), whose closure member (50) is located directly adjacent to the discharge nozzle (8) and whose pressure dependently operating control device (18) is arranged completely within the casing (2). The control device (18) is located on a support unit (5) separate from the casing (2) and defining ducts (28, 29, 38, 47) for two separate media. Thus, while achieving simple construction and assembly, a contamination of the stored medium can be prevented.

22 Claims, 4 Drawing Sheets

DISPENSER FOR MEDIA INCLUDING A VALVED OUTLET

TECHNICAL FIELD AND BACKGROUND OF THE INVENTION

Figure 1:
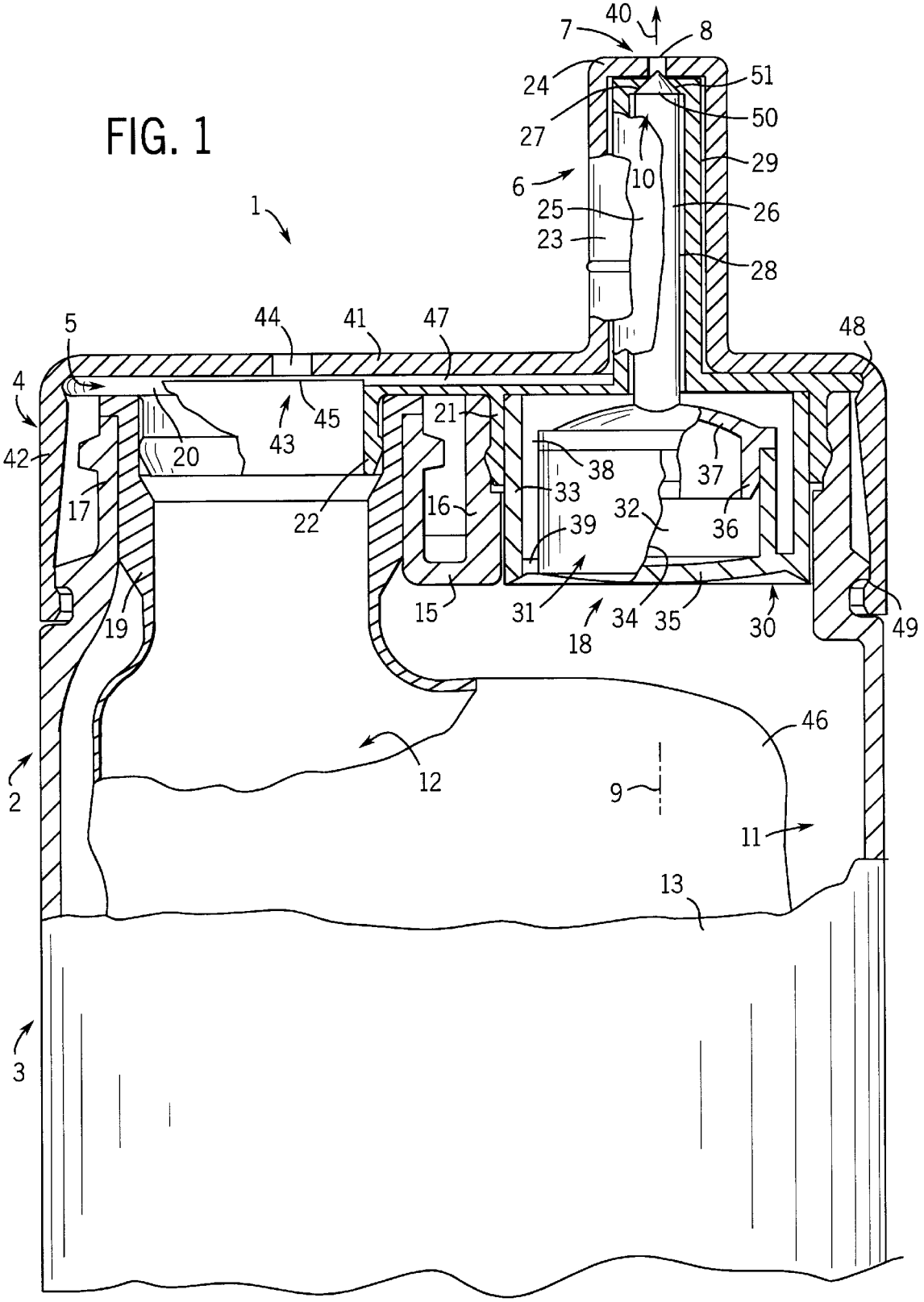

The invention relates to a dispenser as a discharge unit for in particular the pressure-assisted delivery of liquid, gelatinous, pasty, gaseous and/or pulverulent media, which are separated from the dispenser in preferably finely atomized form in the vicinity of the medium outlet and can be discharged into the open. The media can be intended for technical, cosmetic or medical use, e.g. for the treatment of the nose, eyes, throat, skin, etc.

Media are frequently easily perishable, particularly through contamination with bacteria, spores, etc. or by contact with the atmospheric air, so that preservatives and the like must be added thereto in order to permit a long-term storage of the filled discharge unit.

OBJECT OF THE INVENTION

The problem of the invention is to provide a dispenser for media avoiding the disadvantages of known constructions or of the described type and which in particular prevents a contact of the medium enclosed in the discharge unit in the inoperative state with the atmospheric air in a simple manner and with easy assembly.

SUMMARY OF THE INVENTION

According to the invention a valve or closure unit is placed in a discharge connection in the flow direction.

The construction according to the invention is suitable for squeeze bottles, in which the storage chamber for the medium is volume-compressed by gripping with the hand. Means are provided through which the storage chamber is always completely filled with medium independently of the filling state, e.g. in that the storage chamber volume is reduced in proportion to the emptying.

In an axial view, a discharge connection can be set back with respect to a front wall in one or two axial planes at right angles to one another, so as to form on either side finger pressure surfaces for the axial actuation and shortening of the discharge apparatus. The dispenser can have one or more displacement pumps, such as thrust piston pumps. A return stroke medium can be sucked into its pressure or pump zone or chamber to be narrowed. One pressure zone of the simultaneously manually operable pumps can deliver an atomizing gas and the other pump zone substantially simultaneously the non-gaseous medium, so as to discharge in atomized form e.g. a highly viscous medium. The two closures can open and/or close in mutually time-lagged manner. The pressure or pump zone can also contain all the stored medium volume of the discharge apparatus and instead of having an inlet valve facing the plunger can have a permanent closure in the form of the pressure chamber base.

BRIEF FIGURE DESCRIPTION

These and other features can be gathered from the claims, description and drawings and the individual features, either singly or in the form of sub-combinations, can be implemented in an embodiment of the invention and in other fields and can constitute advantageous, independently protectable constructions for which protection is hereby claimed. Embodiments of the invention are shown in the drawings and are explained hereinafter. In the drawings show:

FIG. 1 A dispenser, partly in section.

Figure 2:
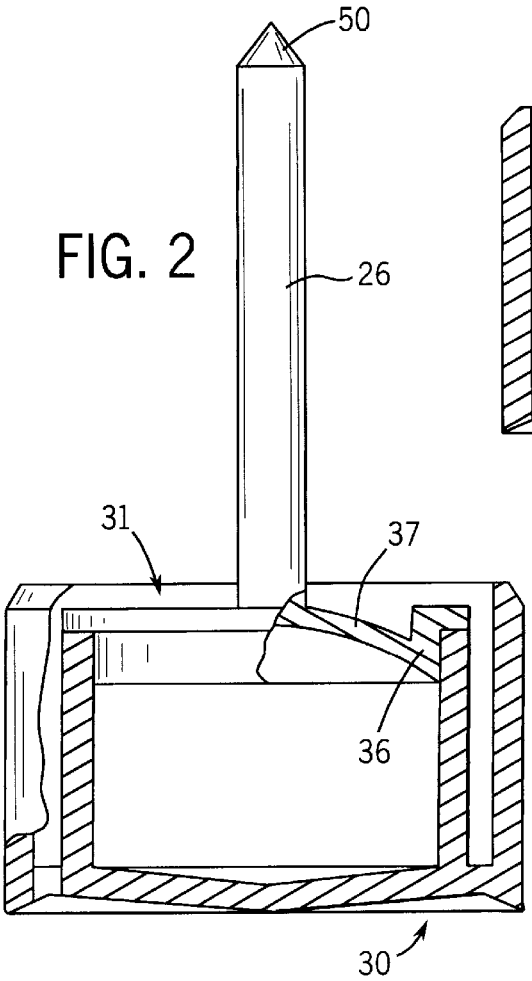

FIG. 2 An assembly unit of the dispenser of FIG. 1 in a modified construction.

Figure 3:
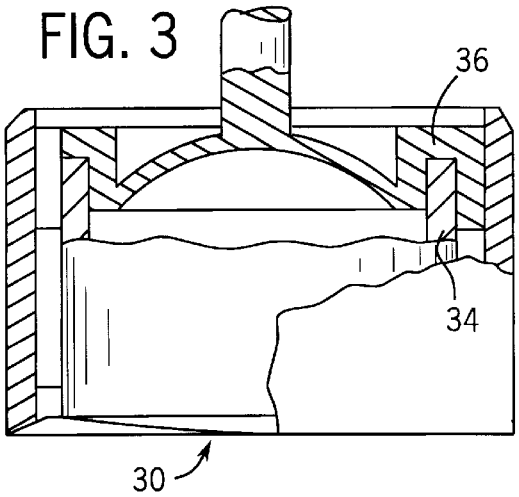

FIG. 3 Another embodiment in a view corresponding to FIG. 2.

Figure 4:
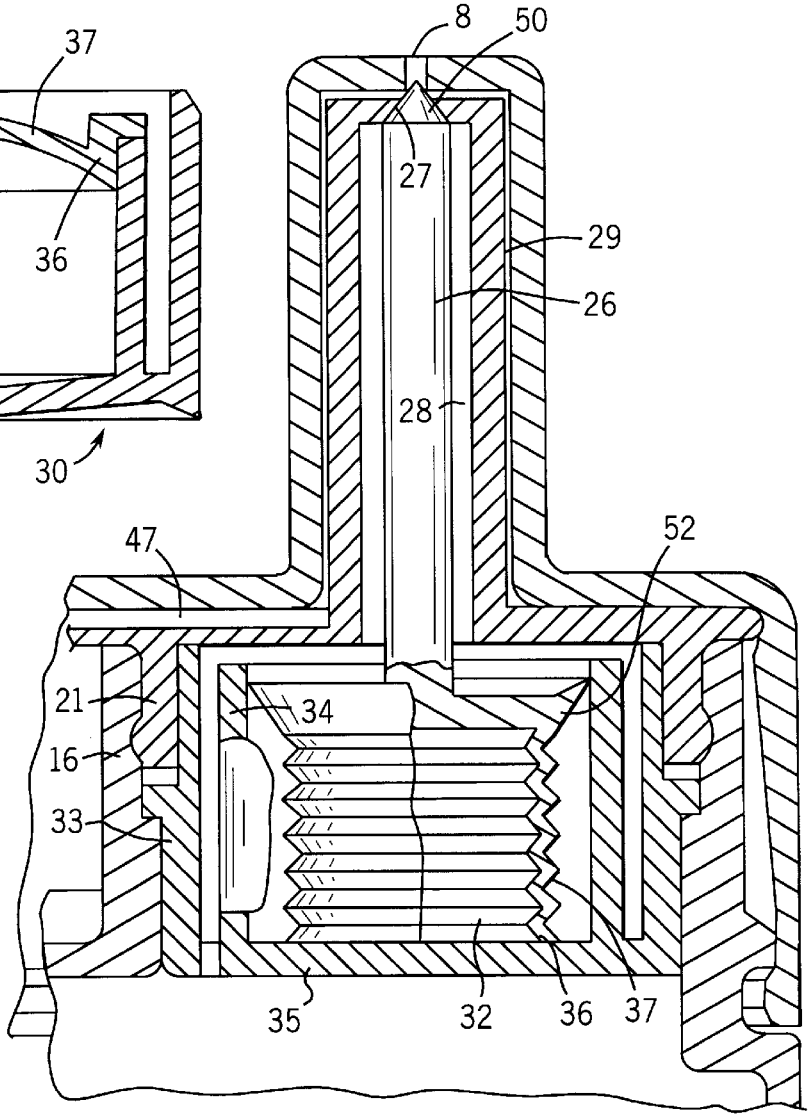

FIG. 4 A detail of FIG. 1, but in a modified construction.

Figure 5:
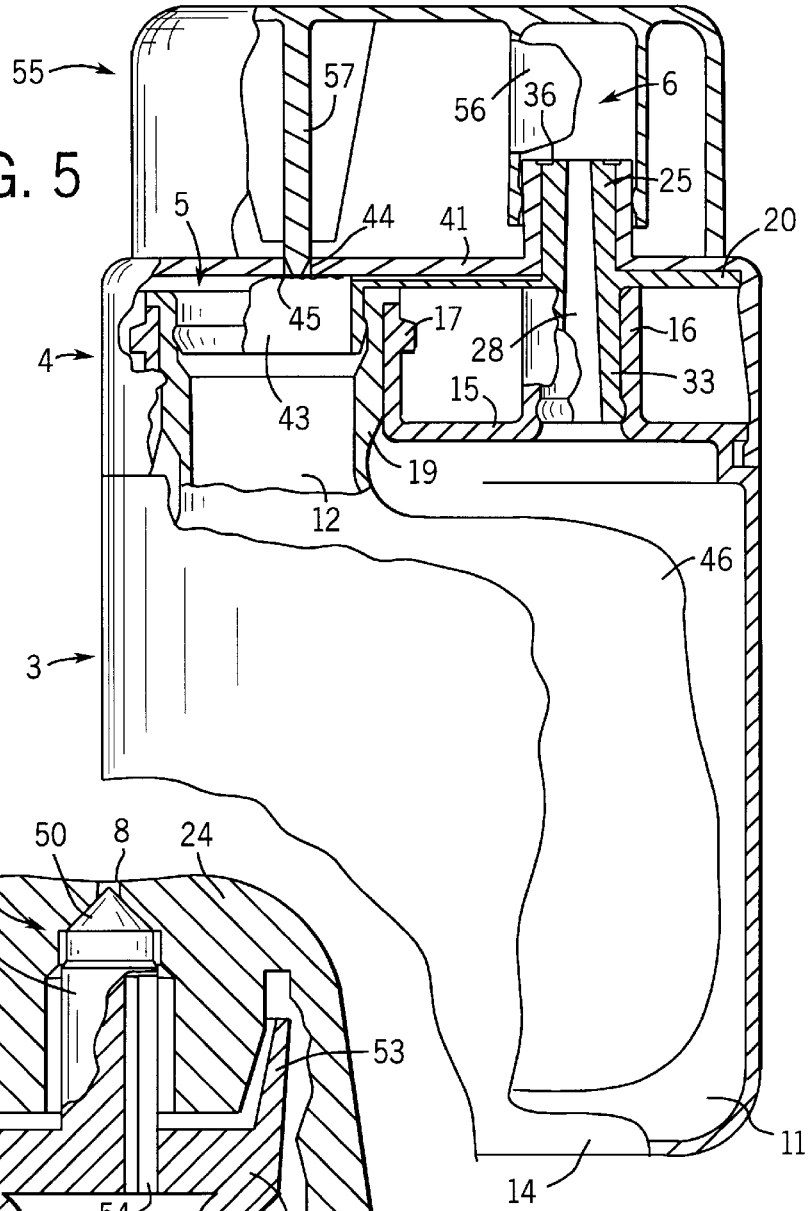

FIG. 5 Another embodiment of a dispenser in a view corresponding to FIG. 1.

Figure 6:
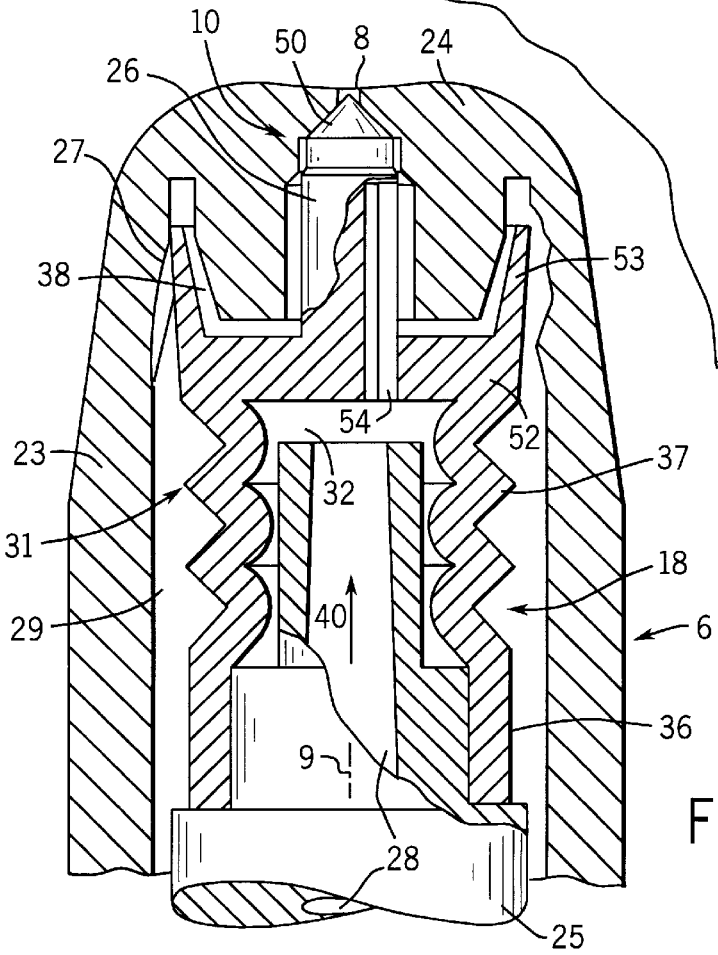

FIG. 6 A larger-scale, sectional representation of FIG. 5.

Figure 7:
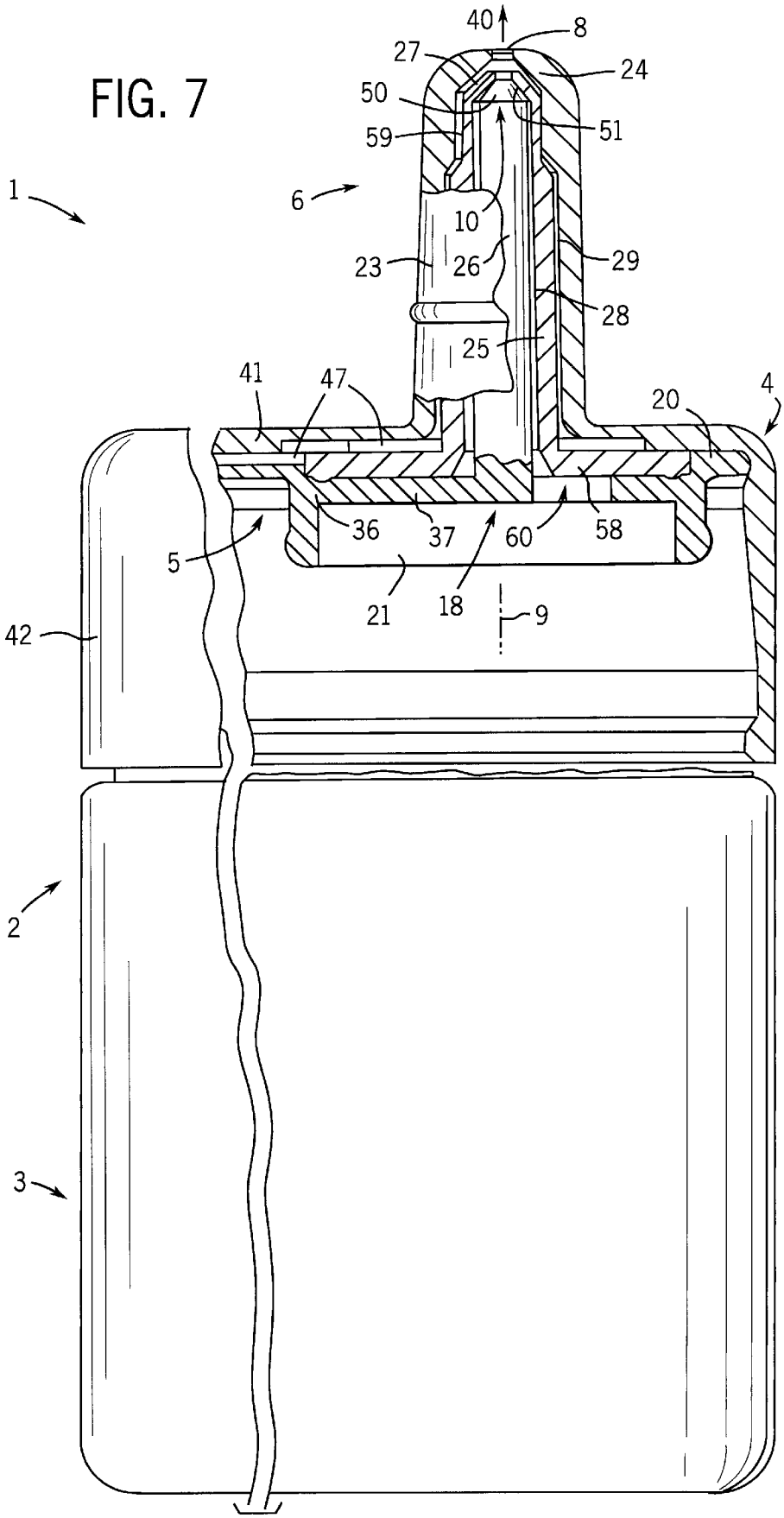

FIG. 7 Another embodiment, partly in section.

DETAILED FIGURE DESCRIPTION

According to FIGS. 1 or 5, the dispenser 1 has an inherently stable or resilient base 2 as the outermost casing. It comprises a container 3 and a cover 4 having the same external shape in an axial view, but which is much shorter than the container 3. Between the casing parts 3, 4 is provided in completely encapsulated form a support unit 5, which is fixed in radially and axially secure manner with respect to the casing part 3 or 4 and is inherently stable like the latter. If a thrust piston pump is fixed with its casing facing the casing part 3, the casing part 4, optionally with the unit 5, would be axially displaceable with respect to the casing part 3 for pump actuation and would carry the plunger. Over the outside of the cover 4 projects axially a connection 6 suitable for introduction into a nostril and its end face contains the medium outlet 7 or a single outlet port 8 with a diameter of less than 1 mm or 0.5 mm. With a spacing of less than 2, 1 or 0.5 mm in front of the opening 8 acts a closure or valve 10, which seals in pressure-tight manner with respect to the external atmosphere the interior of the casing 2 in the inoperative state of the unit 1 and is only opened during medium discharge. The means 6, 8 and 10 are located in an axis 9 laterally displaced with respect to the centre axis of the casing 2.

The interior of the casing 2 contains two first and second storage chambers 11, 12 which are tightly closed with respect to one another and the external atmosphere. The storage chamber 12 is entirely located within the chamber 11. From a closed bottom 14 to an interrupted cover wall 15 the casing 2, 3 has an outermost jacket 13, which in axial view is elongated or flat oval and is flexibly deformable. The volume of the chamber 11 or 12 can be narrowed by radial compression of the jacket 13. Two adjacent, axially parallel connections 16, 17 project from the end wall 15 for the separate filling or emptying of the chambers 11, 12 and the connection 16 can contain a control unit 18. The connection 17 contains a hollow neck 19 of the chamber 12. Like the free end face of the connection 16, the units 18, 19 are adjacent to the inside of a plate 20 of the unit 5 with which an end collar of the neck 19 is sealingly fixed against the connection 17. Two sleeve-like securing means 21, 22 project inwards from the plate 20, one engaging in radially braced manner between the connection 16 and the unit 18. The other engages in a widened portion of the inner circumference of the neck 19 and braces the latter radially against the connection 17.

The projection 6 has an outermost jacket 23, being connected in one piece with the casing 2, 4 and has an at least twice as great a length as is its outside width. At its free end the jacket 23 passes in one piece into a discoid front wall 29 and bounds the nozzle duct 8 passing through it. Said duct can form at the inner end a widened, conical closing or valve seat of the valve 10. Within the connection casing 23 open to the container 3 is fixed a core sleeve 25 and in the latter is axially displaceably arranged a core shaft 26. Immediately adjacent to the front wall 24, the sleeve 25 has a discoid front wall, which forms a preatomizing nozzle 27 at its free end and from which only passes the medium of the chamber 11, accompanied by atomization and consequently flows through the nozzle duct and is then more finely atomized on detachment from the boundary edge of the opening 8 and from the dispenser 1.

The outer circumference of the shaft 26 and the sleeve 25 bound a cross-sectionally annular outlet duct 28, which can alternatively be subdivided into individual axial ducts, which connects the chamber 11 to the openings 8, 27 and can be closed with the valve 10. The sleeve 25 and the inner face of the casing 23, 24 defines at least one second outlet duct 29 surrounding the duct 28 and which connects the chamber 12 to the nozzles 8, 27 and between the front faces of the front walls issues, directed against the axis 9, at the opening 27 and at the inner end of the nozzle duct 8. In this mixing area, with the medium passing out of the nozzle 27 is admixed as a second medium gas or air for finer atomization purposes. The radial portions of the outlet duct 29 can form a twisting device through which the gas is rotated around the nozzle axis and is in this way supplied to the nozzles. The sleeve 25 is a fixed, one-piece component of the support 5 or plate 20 over which it only projects to the outside.

A support casing 30 of the unit 18 separate from the plate 20 projects over the inside of the body 20 and into the connection 16. With radial spacing within the casing 30 is provided a control casing 31, whose jacket 34 and bottom 35 are constructed in one piece with the jacket 33 and bottom of the casing 30 and are connected in fixed manner. The walls 33, 34, 35 are formed by a one-piece component separate from the members 20, 21, 26 and which is fixed in the member 21. At its open, outer end directed towards the opening 8, the jacket 34 is permanently tightly sealed with a cover and engages with a holding portion 36 in fixing manner into the jacket 34.

The front wall of the cap-like cover forms as a valve spring an axially movable, resilient intermediate portion 37 with which is connected in one piece the inner end of the shaft 26 within the members 26, 21, 33 immediately adjacent to the inside of the plate 20. The through constant width of the shaft 26 is much smaller of the convex portion 37 in all positions and which tightly seals the control zone 32 and is axially moved towards the centre of the latter for opening the valve 10.

Between the casings 30, 31 is defined a connecting channel 38 of the outlet duct 28 passing out from the bottom 35. The channel 38 passes out from the connecting openings 39, which traverse the bottom 35 between the jackets 33, 34 around the axis 9 of the casing 30, 31. The channel 38 issues directly into the outlet duct 28. Compared with the duct 28, the channel 38 forms in flow cross-section a greatly widened pressure zone. If medium is pressed out of the chamber 11 into the zone 38, then the portion 37 acts as a plunger or piston, which is moved with the shaft 26 against its spring tension towards the bottom 35 and is returned with said spring tension back to the closed position. The discharge duct 28 or 29 is a capillary duct widened several times compared with the flow cross-section of the channel 38, 39. On narrowing the same in the zone 32 the gas pressure is raised, which also brings about or can adjust the resilient spring tension. The opening movement of the parts 26, 37 is opposed to the flow direction 40 in the ducts 28, 29 or openings 8, 27.

The cover 4 has an outermost front wall 41 and a jacket 42 projecting therefrom from towards the chamber 11 and which projects over a narrowed end portion of the container 3 in the outwards direction up to the front wall 15, so that in it are completely located the connections 16, 17, 19, 21, 22, the plate 20 and the casing 30, 31. The outside of the plate 20 is tensioned against the inside of the wall 41 and forms therewith a sandwich plate 20, 41. The support 5, 20 can be fixed assembled prior to the mounting of the cover 4 thereon or on the container 3 and the cover 4 can then be placed on the container 3, after previously the chamber 12 with the neck 19 being inserted through the connection 17. The preassembled unit of casings 30, 31 and shaft 26 can be fixed to the cover 4 before or after the assembly of the support 20. Appropriately firstly the chamber 12 is inserted and then optionally the support 5 and then the cover 4.

The chamber 12 is line-connected with the external atmosphere via an inlet valve 43, which is located on the inside of the wall 41 within the member 22. The wall 41 has an inlet 44, which can be closed or opened with a pressure-dependently movable valve body 45. The flap-like valve body 45 is constructed in one piece with the support 5, 20 and is movable in articulated manner against spring tension for opening purposes. The valve body 45 is located in the plane of the plate 20. The chamber 12 is defined by a bag 46 made from a highly flexible, foldable, microthin film, which without damage can be crumpled to its material volume in the neck 19 and can therefore-be easily inserted in the container 3. Compared with the film, the neck 19 has a much greater wall thickness and can be constructed in one piece with the bag 46. From the connection 22, adjacent to the valve 43 branches off a connecting channel 47 towards the inlet end of the duct 29. The cross-section of the channel 47 is defined by the parts 20, 41. The passage cross-section of the channel 47 is much wider than the duct 29.

The free end of the shaft 26 forms as the valve body 50 a conically pointed closure member, being located in the closed position at the valve seat 51 forming the opening 27. If the container 3 is compressed without deforming the cover 4 and the chambers 11, 12 are placed under pressure, the valve 43 is secured in its closed position. From the chamber 12 the medium successively flows through the means 19, 22, 47, 29 to the inner end of the nozzle duct 8 not closed by the closure member 50 and passes through the same along the outer circumference of the closure member 50 to the outside, because said member 50 over a part of the duct length projects with its tip into the nozzle duct. Simultaneously the medium flows out of the chamber 11 through the opening 39 and into the pressure zone 38, which is still closed by the valve 10. The pressure brings about the opening of the member 50. The medium can flow out of the pressure zone 38 through the duct 28 into the opening 27, where it mixes with the air already flowing there and then passes out of the nozzle 8. In the open position, the member 50 forms with the valve seat 51 an annular nozzle opening 27, whose greatest width is at the most as large as the opening 8.

As soon as the container 3 is manually relieved and the pressure in the chambers 11, 12, 38 is reduced, the valve 10 closes, whilst medium can still flow out of the chamber 12 through the opening 8 and can exert a cleaning action. As soon as the valve 43 opens in pressure-dependent manner, air is sucked into the chamber 12. The chamber 11 can be always completely filled in bubble-free manner with medium and can also be completely emptied, namely until the bag 46 of the casing 2, 3 is completely filled.

The unit 5 is fixed to the part 4 with a snap connection 48. The outer edge of the plate 20 forms a snap-action member, which is secured in a counter-member on the inner circumference of the cover 4. The cover 4 is so fixed with a corresponding snap connection 49 on container 3 that it secures the plate 20 and neck 19 between the end faces of the connections 16, 17 and the wall 41. By means of a snap connection the member 21 engages in the inner circumference of the connection 16. All the described components are made from plastic and, with the exception of part 46, are inherently stable. The dispenser 1 can only be made from plastic. The means 16, 18, 30, 31 are located in the axis 9. The chamber 11 can be filled through the connection 16.

According to FIG. 1 the sleeve 36 projects inwards from the portion 37. According to FIG. 2 it does not project over the spherically curved inside of the portions 37. By insertion in the member 21, the unit 30 forms part of the unit 5. According to FIG. 3 the sleeve 36 engages with a portion over the outer circumference of the jacket 34 and is radially fixed between the jackets 33, 34. According to FIGS. 2 and 3 the portion 33 projects outwards at the most up to the outer front face of the sleeve 36.

In FIG. 4 the through-constant passage cross-section of the duct 28 is much larger than that of the duct 29. The jacket 33 strikes with an annular projection against a shoulder of the connection 16. The member 50 also closes the inner end of the nozzle duct 8 and the inner ends of the radial portions of the duct 29. The inside spacing between the connections 16, 17 is much smaller than their individual width.

The zone 32 is defined by a cup-like bellows 37 or a jacket located with radial spacing within the jacket 34, whose open end forms the raisably, supported sleeve 36 on the bottom 35. The other end passes in one piece into a discoid plunger 52, from which the shaft needle 26 passes out in one piece and slides with a sealing lip on the jacket 34. Thus, between the jackets 27, 34 is defined a further, annular zone, which is always blocked in sealed manner with respect to the media from the chambers 11, 12.

According to FIGS. 5 and 6 not only the core 25, but also the jacket 33 is a one-piece component of the unit 5, 20. Part 33 takes over the functions of the member 21 according to FIG. 1 and is fixed by a snap connection in the connection 16, whose width is much smaller than that of the connection 17. In the flow direction the duct 28 is tapered in acute-angled manner and over most of the length of the roughly equally wide sleeves 33, 25 is only defined by the latter or the support 20. The valve shaft 26 is provided with the device 18 completely within the connection 16 and only receives part of its length.

The casing 31 is formed by a separate, one-piece component, which is fixed to the outer, width-reduced end of the shaft 25 by mounting in opposition to the direction 40 and contains the portions 36, 37, 52, as well as a further valve body 53 for the duct 29. The sleeve 36 is mounted in fixed manner on the reduced portion of the shaft 25 and is directly connected to the bellows 37, whose sleeve-like sealing lip 53 slides in sealing manner on the jacket 23. Like the lip 53, the shaft 26 projects in direction 40. It is surrounded by the member 53 and in the latter by an upstream directed sleeve projection of the front wall 24. Into the sleeve 37 projects a further reduced end portion of the shaft 25 approximately up to the front wall of the plunger 52. The duct 28 issues into the chamber 32, which surrounds this end projection. The front wall of the plunger 52 is traversed by an intermediate channel 54 connecting the chamber 32 to the chamber 38, which is defined by the interior of the plunger 52, the sleeve projection and the shaft 26. The channel 54 is continued in the form of a groove along the shaft 26.

If medium flows under pressure through the duct 28 into the chamber 32, it passes from there via the channel 54 into the chamber 38, so that, counter to the direction 40, the control plunger 52 is moved with respect to the connection 6 and the shaft 25, accompanied by the pretensioning of the spring 37. The sealing lip 53 slides into the vicinity of depressions or grooves 27 on the inner circumference of the jacket 23, so that the line connection between the duct 29 and chamber 38 is opened. Gas flows through the openings 27 into the chamber 38 and takes the medium past the opened member 50, so that it is discharged in the form of a mixed medium-air flow. The opening of the valve 10 can take place shortly prior to the opening of the valve 27, 53. In the direction 40, member 50 projects more than the member 53. After freeing from the manual actuating force the members 50, 53 simultaneously return to their closed position through the tension of the spring 37.

The connection 6 and/or inlet 44 can be outwardly covered by a removable protective body or a cap-like cover 55. The latter has a cover sleeve 56 narrowly adapted to the connection 6 and which closes the opening 8. In the vicinity of its free end it is locked in axially secured manner in the connection 6 by means of a resilient snap connection. A further closing body 57 for the inlet 44 projects freely from the inside of the cover wall, separately from the closing body 56 and spaced therefrom and engages in the opening 44. The needle 57 can keep the valve 43 slightly open for the pressure compensation of the chambers 11, 12.

According to FIG. 7 the core part 25 controls the medium flow at the opening 8. The sleeve 25 is made from a much more resilient material compared with the remaining materials. Under the medium pressure it performs an opening movement with the seat 51 with respect to the member 2, 4 or the member 50 in the direction 40 for the opening of the closure 10. This can only take place through a resilient longitudinal extension of the core 25 or in that the core 25 is movably mounted with a spring. A support 58 of the core 25 is plate-like or right-angled, tranversely to the axis 9, discoid, in one piece with the core 25 and like the latter constructed separately from the unit 5 or support 20. The latter receives in a depression the support 58 or the associated unit 60, which is secured by a snap connection. The support 58 is deformed in the direction of the axis 9 in the form of a disk spring.

The outer end 27 of the core 25 is obtuse-angled, conically constructed on the outer circumference. This conical end portion faces with gap spacing a complimentary inner cone of the wall 24. This inner cone is directly connected with its narrowest point to the end duct 8. The seat 51 and member 50 have an equally large or somewhat more acute cone angle compared therewith. During its axial movement the seat 51 rises from the member 50 and the end wall of part 25 strikes against wall 24. An axial channel 59 connects the duct 29 to the gap between the end walls. The channel 59 can be exclusively formed by at least one groove on the inner circumference of the jacket 23 and is defined along the open groove longitudinal side with respect to the outer circumference of the stepped reduced end portion of the core 25, which leads to an acceleration or turbulence of the medium.

The core 26 can be rigidly mounted, e.g. by a one-piece connection with the unit 5, 20. This connection can also form the resilient portion 37 in the form of a tongue, membrane, etc. and be located roughly in the plane of the plate 20. Within the member 21 the portion 37 forms a front wall with a passage for the medium. The support 58 is axially fixed between said front wall and the wall 41. The duct 28 is continuously conically narrowed in the flow direction up to the seat 51.

The resilience of the valve seat 51 to the closed position can also take place in such a way that at the start of the discharge actuation initially a large amount of air flows into the opening 8 and then, accompanied by a simultaneous reduction of this air flow, the medium flow commences and following onto the termination thereof the air flow is again increased.

All the embodiments according to FIGS. 1 to 7 can be combined. All the explained characteristics can be provided precisely as described or only substantially as described, the in each case explained functions also being implementable by other members. One-piece constructed members can also be separate parts, which are interconnected in fixed manner.

What is claimed is:

1. A dispenser for discharging media comprising:

a dispenser body (4);

a discharge stud (6) freely projecting from said dispenser body (4) and including a free stud end;

a nozzle duct (8) traversing said free stud end of the discharge connection (6) and including an outer outlet end;

an outlet duct (28) including said nozzle duct (8), said outlet duct (28) defining a flow direction (40);

a medium outlet (7) substantially defined by said outer outlet end;

a valve (10) for controlling flow of the medium, said valve (10) including a valve seat (51) and a valve body (50) operable to vary from a first state to a second state;

an end wall (20, 41) oriented transverse to said discharge stud (6) and manually freely accessible when the medium is discharged, and a support (5), said valve body (50) being displaceably mounted on said support (5) to vary from said first state to said second state and to define a preassembled control unit (18), commonly with said support (5), said control unit (18) being inserted into said dispenser body (4) substantially in said flow direction (40) and said valve body (50) being inserted through said end wall (20, 41) and into said discharge stud (6) substantially parallel to said flow direction (40), said support (5) axially fixedly connecting to said dispenser body (4).

2. The dispenser according to claim 1, wherein said control unit (18) includes a valve spring (37) for actuating said valve body (50), said first state including a substantially closed state of said valve (10), when varying from said second state to said first state said valve body (50) moving substantially codirectional with said flow direction (40), said valve spring (37) being made in one part with said valve body (50).

3. The dispenser according to claim 2, wherein said valve (10) includes an oblong core bolt (26) made in one part and including a free bolt end, said core bolt (26) at least partly traversing said discharge stud (6) downstream of said end wall (20, 41) and including an upstream end directly connecting to said valve spring (37).

4. The dispenser according to claim 1 and further including a valve spring (37), wherein said valve spring includes a pressure box including a deformable pressure space resiliently stressing said valve (10).

5. The dispenser according to claim 1, wherein inside said dispenser body (4) said support (5) is positionally rigidly secured with a snap connection (48).

6. The dispenser according to claim 5, wherein said support (5) includes a snap bead (48) annularly and spacedly surrounding said outlet duct (28), said snap bead (48) being located close to said end wall (20, 41) and resiliently engaging a snap recess.

7. The dispenser according to claim 1, wherein said support (5) includes a support plate (20) oriented transverse to said flow direction (40) and projecting radially over said valve body (50), said support plate (20) and said end wall (41) being directly juxtaposed in substantially parallel orientation.

8. The dispenser according to claim 7, wherein said support plate (20) includes a marginal rim (48) fixedly directly engaging said dispenser body (4) and located in the vicinity of said end wall (41).

9. The dispenser according to claim 1, wherein commonly with said support (5) said valve seat (51) is assemblingly inserted inside said discharge stud (6).

10. The dispenser according to claim 1 and further including a core socket (25) including a free socket end, said socket end including said valve seat (51), upstream of said valve seat (51) said core socket (25) narrowly enveloping said valve body (50), a gap being defined between said valve body (50) and said core socket (25), said core socket (25) including a downstream end providing an annular end wall (27), said annular end wall being traversed by said valve seat (51).

11. The dispenser according to claim 1, wherein said outlet duct includes separate first and second outlet ducts (28, 29) substantially separately and entirely traversing said discharge stud (6), said discharge stud (6) being oblong.

12. The dispenser according to claim 11 and further including an atomizing nozzle and a mixing chamber for mixing the media, wherein between said nozzle duct (8) and said atomizing nozzle said second outlet duct (29) directly issues into said mixing chamber, said valve seat (51) including said atomizing nozzle, said second outlet duct (29) being cross-sectionally commonly bounded by said support (5) and said discharge stud (6).

13. The dispenser according to claim 1 and further including a dispenser base body (3) separate from said dispenser body (4), wherein said support (5) includes a connecting member (21, 22) freely projecting in an upstream direction and connecting said dispenser body (4) with said dispenser base body (3).

14. The dispenser according to claim 13, wherein said connecting member (21, 22) bounds said outlet duct (28, 47), with an upstream end said connecting member (21, 22) connecting to said end wall (20, 41).

15. The dispenser according to claim 13, wherein said connecting member includes laterally spaced first and second connecting members (21, 22), said first connecting member (21) internally receiving a valve tappet (26) supporting said valve body (50), said second connecting member (22) directly connecting to a pressure chamber (12) and ductingly interconnecting said pressure chamber (12) and said medium outlet (7).

16. The dispenser according to claim 1 and further including separate first and second storage chambers (11, 12) for separately storing the media in multiple discharge doses, wherein said first and second storage chambers (11, 12) are internested and ductingly connected to said media outlet (7), a dispenser base (2) being provided and directly bounding said first storage chamber (11), said second storage chamber (12) being directly bounded by a slack bag (46) positionally held on said dispenser base (2) by said support (5).

17. The dispenser according to claim 16 and further including a dispenser base (2), wherein said dispenser base (2) is assembled from a container (3) and said dispenser body includes a container cover, said container (3) including first and second container openings, said support (5) including first and second securing members (21, 22), a valve spring (37) and said first securing member (21) engaging inside said first container opening, a neck (19) and said second securing member (22) engaging inside said second container opening.

18. The dispenser according to claim 1, wherein said outlet duct includes separate first and second outlet ducts (28, 29) and said valve body includes first and second valve bodies (50, 53) positionally interconnected, said first valve body (50) being provided for directly controlling flow of the media through said first outlet duct (28), said second valve body (53) being provided for directly controlling flow of the media through said second outlet duct (29).

19. The dispenser according to claim 18, wherein said first and second valve bodies (28, 29) are coaxially internested, a media closure being provided and including a slide valve, said slide valve including one of said first and second valve bodies (53) including a piston lip.

20. The dispenser according to claim 1, and further including a storage chamber (12) ductingly connected to said media outlet (7) and to the environmental atmosphere via a venting valve (43), wherein said support (5) includes a movable valve body (45) of said venting valve (43), said dispenser body (4) including a closure seat of said venting valve, said support (5) including a support plate (20) axially covering a container (3) substantially entirely, said support plate (20) including securing members (21, 22) and a core socket (25), said support plate (20) defining remote first and second plate sides, said securing members (21, 22) projecting only over said first plate side and said core socket (25) projecting over said second plate side and into said discharge stud (6), said valve (10) including a valve spring (37), a snap connection being provided for interconnecting said valve seat (51) and said valve spring (37).

21. The dispenser according to claim 1 and further including a storage chamber (11, 12) for storing the media, wherein said storage chamber (11, 12) includes at least one squeeze container (3) manually volumetrically variable only at a distance from said dispenser body (4), said squeeze container (3) being resiliently deformable and said dispenser body (4) being dimensionally stiff.

22. The dispenser according to claim 1, wherein in an axial view said dispenser (1) is oblong over at least part of an overall length extension defined by said dispenser (1).

* * * * *